US006452621B1

(12) United States Patent
Nakamura

(10) Patent No.: US 6,452,621 B1
(45) **Date of Patent: *Sep. 17, 2002**

(54) THERMAL HEAD

(75) Inventor: Jun Nakamura, Amimachi (JP)

(73) Assignee: Riso Kagaku Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 233 days.

(21) Appl. No.: 09/650,818

(22) Filed: Aug. 30, 2000

(30) Foreign Application Priority Data

Aug. 31, 1999 (JP) ..... 11-245842

(51) Int. Cl.[7] ..... B41J 2/335
(52) U.S. Cl. ..... 347/208
(58) Field of Search ..... 347/200, 202, 347/204, 208

(56) References Cited

U.S. PATENT DOCUMENTS

| | | | |
|---|---|---|---|
| 5,097,272 | A | 3/1992 | Tsumura et al. |
| 5,216,951 | A | 6/1993 | Yokoyama et al. |
| 5,315,319 | A | 5/1994 | Sato et al. |
| 5,415,090 | A | 5/1995 | Natori et al. |
| 5,417,156 | A | 5/1995 | Tateishi et al. |
| 5,559,546 | A | 9/1996 | Sato |
| 5,592,209 | A | 1/1997 | Hasegawa et al. |
| 5,786,839 | A | 7/1998 | Itoh |

FOREIGN PATENT DOCUMENTS

| | | |
|---|---|---|
| EP | 0 395 978 B1 | 11/1990 |
| EP | 0 500 334 A2 | 8/1992 |
| JP | 60-208244 | 10/1985 |
| JP | 63-191654 | 8/1988 |
| JP | 2-67133 | 3/1990 |
| JP | 4-71847 | 3/1992 |
| JP | 4-314552 | 11/1992 |
| JP | 5-185574 | 7/1993 |
| JP | 5-345401 | 12/1993 |
| JP | 5-345402 | 12/1993 |
| JP | 5-345403 | 12/1993 |
| JP | 6-115042 | 4/1994 |
| JP | 7-171940 | 7/1995 |
| JP | 8-132584 | 5/1996 |
| JP | 8-142299 | 6/1996 |

OTHER PUBLICATIONS

European Search Report.

*Primary Examiner*—Huan Tran
(74) *Attorney, Agent, or Firm*—Nixon Peabody, LLP; Donald R. Strudebaker

(57) ABSTRACT

A thick film thermal head for making a stencil by thermally perforating a stencil material includes an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes. The resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, and the length in the sub-scanning direction of the resistance heater at the portion between each pair of adjacent electrodes is not smaller than 100% and not larger than 250% of the center distance between the adjacent electrodes.

9 Claims, 4 Drawing Sheets

THERMAL HEAD

BACKGROUND OF THE INVENTION

1. Field of the Invention

This invention relates to a thermal head for making a stencil by thermally perforating a heat-sensitive stencil material, and more particularly to an inexpensive thermal head formed by a thick film process.

2. Description of the Related Art

In stencil making apparatuses which have been put into practice, a heat-sensitive stencil material is used, and there have been known two stencil making systems. One of the stencil making systems is so-called a flash system in which an original having a printing area containing therein carbon is brought into a close contact with a heat-sensitive stencil material is perforated by heat when a printing area of the original is exposed through the stencil material to flashlight from a flash bulb, a xenon flashtube or the like. The other stencil making system is so-called a digital system in which a stencil material is thermally perforated by selectively energizing heater elements of a thermal head according to an image signal read out from an original through an image sensor or the like, or an image signal representing a document and/or an image created through a computer or the like. The digital system is now prevailing over the flash system since the digital system permits the document editing and the image processing. Though the thermal head was once a device exclusively used in facsimiles, thermal recording printers or the like, recently the thermal head has been modified so that it can be used in thermal stencil making. Recently, the modified thermal head has come to be used in a thermal stencil making apparatus of the digital system. As the stencil material, there have been known one comprising thermoplastic resin film laminated to a porous base sheet and one comprising thermoplastic resin film with no base sheet.

Specific structures of thermal heads to be used in thermal stencil making are disclosed, for instance, in the following patent publications.

In Japanese Unexamined Patent Publication Nos. 63(1988)-191654 and 6(1994)-191003, the thickness of the protective layer of the thermal head is defined. In Japanese Unexamined Patent Publication Nos. 2(1990)-67133, 4(1992)-71847, 4(1992)-265759, 5(1993)-345401, 5(1993)-345402, 5(1993)-345403 and 6(1994)-115042, the length in the main scanning direction of the heater element and/or the length in the sub-scanning direction of the same is defined for the pitch of the heater elements in each direction. In Japanese Unexamined Patent Publication Nos. 4(1992)-45936, 7(1995)-68807 and 7(1995)-171940, there is disclosed a thermal head in which the heater element is not rectangular in shape. In Japanese Unexamined Patent Publication Nos. 4(1992)-314552 and 8(1996)-142299, there is disclosed a thermal head in which a cooling member is disposed between each pair of adjacent heater elements. In Japanese Unexamined Patent Publication Nos. 4(1992)-369575 and 8(1996)-132584, the shape or thickness of the glaze layer is defined. Further, in Japanese Unexamined Patent Publication No. 5(1993)-185574, the ratio of the length in the main scanning direction to the length in the sub-scanning direction of the heater element is defined.

Though not clearly described in the above patent publications, the thermal heads disclosed in the above patent publications can be considered to be of a thin film type except those disclosed in Japanese Unexamined Patent Publication Nos. 5(1993)-345401, 5(1993)-345402 and 5(1993)-345403. Actually, at present almost all the thermal stencil making apparatuses using a thermal head use a thin film thermal head, and those using a thick film type thermal head are limited to those for a postcard, those which function also as a word processor printer and those which function also as a heat transfer labeler. Only a very small fraction of the digital system thermal stencil making apparatuses uses a thick film type thermal head.

As pointed out by many of the aforesaid patent publications, it is preferred that the thermoplastic resin film of the stencil material be perforated in such a manner that perforations are discrete and adjacent perforations are not connected to each other. This is because of inherent characteristics of stencil printing that ink is viscous fluid and spreads wider than the area of the perforations when transferred to the printing paper through perforations of the stencil, and when the perforations are connected, the amount of ink transferred to the printing paper and the thickness of printed ink layer on the printing paper are acceleratedly increased and offset is caused. The thermal head for thermal stencil making differs in this point from that for thermal recording in which that recorded pixels overlaps each other is preferred.

In the digital system thermal stencil making, it is preferred that the perforations be separated from each other, the proportion of open area (the proportion of the area of the perforations per unit area of the thermoplastic film of the stencil material) be in a predetermined range (generally about 30 to 40% though depending upon the viscosity of the ink, the kind of the printing paper, the pressure at which the stencil is pressed against the printing paper, and the like) in order to ensure a proper printing density, and the shapes and the areas of the perforations be substantially uniform so that the unperforated portions between the perforations are arranged in a regular pattern and the densities of large printing areas such as solid parts are uniformed.

Typically, the thin film thermal head comprises a heat radiating plate of metal, an electrical insulating substrate and a glaze layer formed on the heat radiating plate in this order, a plurality of strip-like resistance heaters which are formed on the glaze layer to extend in one direction (the sub-scanning direction) and are arranged in a direction transverse to said one direction (the main scanning direction), and a plurality of electrodes each superposed on one of the strip-like resistance heaters with a part of the resistance heater exposed through a gap formed in the electrode. The exposed part of each strip-like resistance heater forms a heater element. That is, a pair of electrodes are formed on each resistance heater with their inner ends opposed to each other in the sub-scanning direction with a gap between. One of the electrodes is connected to a switching element for discretely energizing the heater element and the other electrode are integrated with the corresponding electrodes for the other heater elements to form a common electrode. When producing such a thin film thermal head, an electrical insulating substrate and a glaze layer are superposed on a heat radiating plate and a solid resistance heater layer and a solid electrode layer are formed in this order on the glaze layer. Then the electrode layer is removed along a line extending in the main scanning direction, thereby exposing the resistance heater layer in a line extending in the main scanning direction, and the resistance heater layer and the electrode layer are both removed in the sub-scanning direction at regular intervals in the main scanning direction. Thus, a plurality of strip-like resistance heater layers are formed each covered with a pair of electrode layers opposed to each other in the sub-scanning direction with a gap between. One of the electrode layer is connected to a switching element and forms a discrete electrode for discretely energizing the part of the resistance heater layer free from the electrode layer. The other electrode layer is integrated with the corresponding electrode layer for the other strip-like resistance heater layers to form a common electrode. A protective layer is formed to cover the discrete electrodes, the exposed part of the resistance heater layer and the common electrode. When an electric potential different from the common electrode is applied to a discrete electrode, the exposed part of each of the strip-like resistance heaters between the discrete electrode and the common electrode is energized and generates heat. That is, the exposed part of each of the strip-like resistance heaters between the discrete electrode and the common electrode forms a heater element.

Since the thin film thermal head is generally very small in heat capacity as compared with the thick film thermal head and the heater elements are separately independent of each other, the temperature distribution on the thermal head during operation is clear and the temperature difference between the high-temperature part and the low-temperature part (will be referred to as "the temperature contrast", hereinbelow) is large, whereby the thermoplastic resin film of the stencil material can be perforated in relatively uniform shapes according to the clear pattern of the temperature distribution. For this reason, in almost all of high-quality stencil making apparatuses, a thin film thermal head has been employed.

In the thermal recording, thick film thermal heads have been much employed as well as the thin film thermal heads. Typically, the thick film thermal head comprises a heat radiating plate of metal, an electrical insulating substrate and a glaze layer formed on the heat radiating plate in this order, discrete electrodes and common electrodes which are formed on the glaze layer alternately in the main scanning direction to extend in opposite directions in the sub-scanning direction with their inner end portions overlapping with each other in the main scanning direction, a strip-like resistance heater formed over the discrete electrodes and the common electrodes to extend in the main scanning direction across the discrete electrodes and the common electrodes, and a protective layer formed to cover the discrete electrodes, the common electrodes and the strip-like resistance heater.

When an electric potential different from the common electrode is applied to a discrete electrode, the parts of the strip-like resistance heater between the discrete electrode and two common electrodes on opposite sides of the discrete electrode are energized and generate heat. Each of the parts between the discrete electrodes and the common electrodes forms one heater element. However since on and off of the heater elements on opposite sides of a discrete electrode cannot be controlled independently of each other, that is, when one discrete electrode is applied with an electric potential, both the heater elements generate heat, and when one discrete electrode is not applied with an electric potential, none of the heater elements generate heat, the two heater elements should be considered to correspond to one pixel. The recording using such a thermal head will be referred to as "twin-dot recording", hereinbelow. When first common electrodes and second common electrodes of different lines are alternately disposed in place of the common electrodes so that the first and second common electrodes are electrically connected with one discrete electrode at different timings, on and off of the heater elements on opposite sides of a discrete electrode can be controlled independently of each other. In this case, one heater element corresponds to one pixel. The recording using such a thermal head will be referred to as "single-dot recording", hereinbelow.

In Japanese Unexamined Patent Publication Nos. 5(1993)-345401, 5(1993)-345402 and 5(1993)-345403, there is disclosed a thick film thermal head in which the lengths in the main and sub-scanning directions of each heater element (corresponding to one pixel) are smaller than scanning pitches in the main and sub-scanning directions, respectively, and the ratio of the length of the heater element in the main scanning direction to the main scanning pitch is substantially equal to the ratio of the length of the heater element in the sub-scanning direction to the sub-scanning pitch. The patent publications also say that the lengths in the main and sub-scanning directions of each heater element are equal to the diameters of a perforation in the main and sub-scanning directions, respectively. However, a stencil making apparatus using such a thick film thermal head has not been in wide use due to a problem in performance to be described later.

As can be understood from the description above, presently, substantially all the thermal stencil making apparatuses use the thin film thermal head.

The thick film thermal head is advantageous over the thin film thermal head by the following reasons: First, the productive facilities for the thick film thermal head is simpler and easier to manage than that for the thin film thermal head and accordingly, the thick film thermal head can be produced at lower cost. Second, unlike the thin film thermal head, the thick film thermal head can be produced in an open atomosphere without using, for instance, a sputter chamber in which the thermal head is to be confined, and accordingly, the thick film thermal head can be easily produced long. Accordingly, there has been demand for using the thick film thermal head in thermally making a stencil.

However, when the conventional thick film thermal head is used in thermal stencil making as it is, there arises a problem that printings made by the use of a stencil made by the thick film thermal head become lower in image quality. That is, as described above, the thick film thermal head is low in the temperature contrast as compared with the thin film thermal head, that is, the thick film thermal head is small in the temperature gradient as compared with the thin film thermal head. Since the resistance heater of the thick film thermal head is continuous in the main scanning direction, heat generated by each heater element is easily propagated in the main scanning direction. Accordingly, in the thick film thermal head, the temperature contrast in the main scanning direction is lower than in the thin film thermal head. Further, the thick film thermal head is larger in size of each heater element than the thin film thermal head. Especially in the thick film thermal head, the length in the sub-scanning direction of each heater element is generally about three times the scanning pitch in the sub-scanning direction, and accordingly, the temperature gradient in the sub-scanning direction at a given time is small. The volume of each heater element of the thick film thermal head is in the order of hundred times that of the thin film thermal head so long as they are equivalent to each other in resolution. Accordingly, the heater elements of the thick film thermal head is larger in heat capacity than those of the thin film thermal head, which results in slower temperature response to on and off of the applied pulses. This also corresponds to a low temperature contrast in the sub-scanning direction.

The shape of the perforations may be considered to basically correspond to the shape of areas where the experienced temperature on the thermoplastic film becomes not lower than a certain threshold value. However, actually, the temperature fluctuates from heater element to heater element, and the shape of the perforations are more apt to be affected by fluctuation in the temperature of the heat elements as the temperature contrast on the heater element becomes lower. Accordingly, the thick film thermal head is larger than the thin film thermal head in fluctuation of the shape of the perforations. Large fluctuation of the shape of the perforations results in microscopic unevenness in printing density and deteriorates evaluation of image quality. Further, fluctuation in the shape of the perforations is apt to result in enlarged and/or connected perforations, which can result in offset as described above.

Further, a state where the lengths in the main and sub-scanning directions of each heater element are equal to the diameters of a perforation in the main and sub-scanning directions as mentioned in Japanese Unexamined Patent Publication Nos. 5(1993)-345401, 5(1993)-345402 and 5(1993)-345403 is a very special case. This is because, in the thick film thermal head, the resistance heater is semi-cylindrical in cross-section and is the thickest at the middle in the sub-scanning direction, and as the distance from the middle of the resistance heater increases, the surface of the resistance heater becomes remoter from the thermoplastic film of the stencil material and the heat transfer efficiency deteriorates. The resistance heater is about 3 to 20 $\mu$m in thickness. Accordingly, the distance between the surface of the resistance heater and the film of the stencil material is about 3 to 20 $\mu$m at the edges of the resistance heater. In practical setting, at the time when the temperature of the heater element is maximized, the temperature at the middle of the heater element is, for instance, 350 to 400° C., whereas the temperature at edges of the heater element is only 200 to 250° C., which is substantially equal to the melting point of the film. Accordingly, when the edges of the heater element is at a distance of, for instance, 10 $\mu$m in the vertical direction (the direction substantially perpendicular to the surface of the heater element), the perforation in the film can be hardly enlarged to portions opposed to the edges of the heater element.

On the other hand, the resistance heater of the thick film thermal head is substantially uniform in thickness in a cross-section in the main scanning direction. Further since the resistance heater is continuous in the main scanning direction, heat generated by each heater element is easily propagated in the main scanning direction. When printing a solid printing area, adjacent heater elements generate heat simultaneously, and accordingly, the temperature of inter-element portions (portions between the heater elements) is lower than the temperature of the heater elements at the middle thereof (350 to 400° C.) only by about 50° C.

As described above, the temperature contrast of the thick film thermal head highly depends upon the direction. Under such conditions, in order to make the ratio of the length of the heater element in the main scanning direction to the main scanning pitch smaller than 1 and substantially equal to the ratio of the length of the heater element in the sub-scanning direction to the sub-scanning pitch and to make the lengths of the heater element in the main and sub-scanning directions equal to the diameters of the perforation in the respective directions, it is necessary that the heat shrinkage stress of the film is highly anisotropic, which is practically impossible.

As can be understood from the description above, use of a thick film thermal head in thermally making a stencil is practically difficult mainly for reasons of quality of the perforations though proposed in Japanese Unexamined Patent Publication Nos. 5(1993)-345401, 5(1993)-345402 and 5(1993)-345403.

SUMMARY OF THE INVENTION

In view of the foregoing observations and description, the primary object of the present invention is to provide a thick film thermal head which can make a stencil ensuring high quality printings and suppression of offset.

In accordance with a first aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes (the distance between the axes of the adjacent electrodes extending in the sub-scanning direction), and the length in the sub-scanning direction of the resistance heater at the portion between each pair of adjacent electrodes is not smaller than 100% and not larger than 250% of the center distance between the adjacent electrodes.

In accordance with a second aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, and the length in the sub-scanning direction of the resistance heater at the portion between each pair of adjacent electrodes is not smaller than 100% and not larger than 250% of the center distance between the adjacent electrodes.

In accordance with a third aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the resistance heater is not smaller than 1 μm and not larger than 10 μm in thickness, the sum of the space between each discrete electrode and the common electrode on one side of the discrete electrode in the main scanning direction and the space between the discrete electrode and the common electrode on the other side of the discrete electrode in the main scanning direction is not smaller than 20% and not larger than 60% of the center distance between the common electrodes on the opposite sides of the discrete electrode, and the length in the sub-scanning direction of the resistance heater at the portion between each discrete electrode and the common electrode on each side of the discrete electrode is not smaller than 100% and not larger than 250% of the center distance between the common electrodes on the opposite sides of the discrete electrode.

In accordance with a fourth aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in μm) represents the center distance between the adjacent electrodes.

In accordance with a fifth aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein the improvement comprises that the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in μm) represents the center distance between the adjacent electrodes.

In accordance with a sixth aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the following formula (2) is satisfied, $$0.2 \leqq V/D^2 \leqq 10 \quad (2)$$

wherein V (in $\mu m^3$) represents the sum of the volume of a part of the resistance heater between each discrete electrode and the common electrode on one side of the discrete electrode in the main scanning direction and the volume of a part of the resistance heater between the discrete electrode and the common electrode on the other side of the discrete electrode in the main scanning direction and D (in μm) represents the center distance between the common electrodes on the opposite sides of the discrete electrode.

In accordance with a seventh aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the resistance heater is not smaller than 1 μm and not larger than 10 μm in thickness, the space between each pair of adjacent electrodes in the main scanning direction is not smaller than 20% and not larger than 60% of the center distance between the adjacent electrodes, the length in the sub-scanning direction of the resistance heater at the portion between each pair of adjacent electrodes is not smaller than 100% and not larger than 250% of the center distance between the adjacent electrodes, and the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu m$) represents the center distance between the adjacent electrodes.

In accordance with an eighth aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein th e improvement comprises that the resistance heater is not smaller than 1 $\mu m$ and not larger than 10 $\mu m$ in thickness, the space between each pair of adjacent electrodes in the main scanning direction is not smaller than 20% and not larger than 60% of the center distance between the adjacent electrodes, the length in the sub-scanning direction of the resistance heater at the portion between each pair of adjacent electrodes is not smaller than 100% and not larger than 250% of the center distance between the adjacent electrodes, and the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu m$) represents the center distance between the adjacent electrodes.

In accordance with a ninth aspect of the present invention, there is provided a thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the resistance heater is not smaller than lm and not larger than 10 $\mu m$ in thickness, the sum of the space between each discrete electrode and the common electrode on one side of the discrete electrode in the main scanning direction and the space between the discrete electrode and the common electrode on the other side of the discrete electrode in the main scanning direction is not smaller than 20% and not larger than 60% of the center distance between the common electrodes on the opposite sides of the discrete electrode, the length in the sub-scanning direction of the resistance heater at the portion between each discrete electrode and the common electrode on each side of the discrete electrode is not smaller than 100% and not larger than 250% of the center distance between the common electrodes on the opposite sides of the discrete electrode, and the following formula (2) is satisfied, $$0.2 \leqq V/D^2 \leqq 10 \quad (2)$$

wherein V (in $\mu m^3$) represents the sum of the volume of a part of the resistance heater between each discrete electrode and the common electrode on one side of the discrete electrode in the main scanning direction and the volume of a part of the resistance heater between the discrete electrode and the common electrode on the other side of the discrete electrode in the main scanning direction and D (in $\mu m$) represents the center distance between the common electrodes on the opposite sides of the discrete electrode.

That is, the present invention is to compensate for disadvantage of the thick film thermal head that it is low in temperature response and temperature contrast in order to make a high quality stencil with a thick film thermal head which is inexpensive. In accordance with the present invention, temperature response and temperature contrast of the thick film thermal head are improved by limiting the volume of each heater element taking into account the conditions required in the thermal stencil making.

By limiting the thickness of the resistance heater (In this specification, the thickness of the resistance heater or the heater element means a maximum length of the resistance heater or the heater element as measured in the vertical direction perpendicular to the surface plain of the under layer, that is, a glaze layer.) to not larger than 10 $\mu m$ (preferably not larger than 6 $\mu m$), the heat capacity of each heater element is reduced and response of the temperature of the heater element to on and off of the applied pulses is increased, whereby the temperature contrast in the sub-scanning direction is increased and fluctuation of the shapes of the perforations in the sub-scanning direction can be suppressed. At the same time, energy required to heat the heater element to a temperature necessary to perforate the film of the stencil material is reduced and the power consumption can be suppressed. Further, since the total amount of heat to be generated by the heater element is reduced, accumulation of heat is suppressed when a plurality of stencils are continuously made, whereby fluctuation in printing density can be suppressed and offset can be prevented. Further, when the thickness of the resistance heater is smaller than 1 $\mu m$, the shape of the resistance heater comes to largely depend upon the position in the main scanning direction due to limitation in precision of thick film printing process. In other words, uniformity of the shape of the resistance heater in the main scanning direction largely deteriorates, which results in fluctuation in shape, resistance and heat generating properties of the heater elements and results in fluctuation of the shape of the perforations obtained. Accordingly, the thickness of the resistance heater should not be smaller than 1 $\mu m$, and preferably should not be smaller than 2 $\mu m$.

By limiting the inter-electrode space in the main scanning direction as described above, the following effect can be obtained. In "single-dot recording" and in "twin-dot-recording" where two perforations corresponding to one pixel are to be separated from each other (these forms of perforation will be referred to as "single-dot independent perforation", hereinbelow), when the space between each pair of adjacent electrodes in the main scanning direction (the length in the main scanning direction of each heater element) is not larger than 60% (preferably not larger than 50%) of the center distance between the adjacent electrodes (corresponding to the main scanning pitch), the temperature contrast of the heater element is enhanced, whereby fluctuation in the shape of the perforations can be suppressed in the main scanning direction and the perforations can be prevented from connecting to each other in the main scanning direction. Further, in twin-dot-recording" where two perforations corresponding to one pixel are to be connected to each other though a pair of perforations corresponding to one pixel are to be separated from another pair of perforations corresponding to another pixel (this form of perforation will be referred to as "twin-dot independent perforation", hereinbelow), when the sum of the space between each discrete electrode and the common electrode on one side of the discrete electrode in the main scanning direction and the space between the discrete electrode and the common electrode on the other side of the discrete electrode in the main scanning direction is not larger than 60% (preferably not larger than 50%) of the center distance between the common electrodes on the opposite sides of the discrete electrode (corresponding to the main scanning pitch), the temperature contrast of the heater element is enhanced, whereby fluctuation in the shape of the perforations can be suppressed in the main scanning direction and the perforations can be prevented from connecting to each other in the main scanning direction. At the same time, energy required to heat the heater element to a temperature necessary to perforate the film of the stencil material is reduced and the power consumption can be suppressed. Further, since the total amount of heat to be generated by the heater element is reduced, accumulation of heat is suppressed when a plurality of stencils are continuously made, whereby fluctuation in density of printings can be suppressed and offset can be prevented. On the other hand, when the space between each pair of adjacent electrodes in the main scanning direction is smaller than 20% of the center distance between the adjacent electrodes in the single-dot independent perforation or when the sum of the space between each discrete electrode and the common electrode on one side of the discrete electrode in the main scanning direction and the space between the discrete electrode and the common electrode on the other side of the discrete electrode in the main scanning direction is smaller than 20% of the center distance between the common electrodes on the opposite sides of the discrete electrode in the twin-dot independent perforation, heat generating areas become too small in the main scanning direction to form perforations in a proper size (30 to 40% in terms of the proportion of open area), which results in, for instance, a poor printing density. Accordingly, the space between each pair of adjacent electrodes in the main scanning direction should be not smaller than 20% (preferably not smaller than 25%) of the center distance between the adjacent electrodes in the single-dot independent perforation, and the sum of the space between each discrete electrode and the common electrode on one side of the discrete electrode in the main scanning direction and the space between the discrete electrode and the common electrode on the other side of the discrete electrode in the main scanning direction should be not smaller than 20% (preferably not smaller than 25%) of the center distance between the common electrodes on the opposite sides of the discrete electrode in the twin-dot independent perforation.

By limiting the length of the resistance heater in the sub-scanning direction as described above, the following effect can be obtained. When the length in the sub-scanning direction of the resistance heater at the portion between each pair of adjacent electrodes is not larger than 250% (preferably not larger than 200%) of the center distance between the adjacent electrodes in the single-dot independent perforation and when the length in the sub-scanning direction of the resistance heater at the portion between each discrete electrode and the common electrode on each side of the discrete electrode is not larger than 250% (preferably not larger than 200%) of the center distance between the common electrodes on the opposite sides of the discrete electrode in the twin-dot independent perforation, the length of the heater elements in the sub-scanning direction can be not larger than 250% (preferably not larger than 200%) of the sub-scanning pitch in the case where perforations are to be formed in the sub-scanning direction in substantially the same pitch as in the main scanning direction. When the length of the heater elements in the sub-scanning direction is not larger than 250% (preferably not larger than 200%) of the sub-scanning pitch, the temperature contrast of the heater element in the sub-scanning direction is enhanced as compared with the conventional thick film thermal head where the length in the sub-scanning direction of the resistance heater at the portion between each pair of adjacent electrodes is about 300%, whereby fluctuation in the shape of the perforations can be suppressed in the sub-scanning direction and the perforations can be prevented from connecting to each other in the sub-scanning direction. At the same time, energy required to heat the heater element to a temperature necessary to perforate the film of the stencil material is reduced and the power consumption can be suppressed. Further, since the total amount of heat to be generated by the heater element is reduced, accumulation of heat is suppressed when a plurality of stencils are continuously made, whereby fluctuation in printing density can be suppressed and offset can be prevented. On the other hand, when the length in the sub-scanning direction of the resistance heater at the portion between each pair of adjacent electrodes is smaller than 100% of the center distance between the adjacent electrodes in the single-dot independent perforation and when the length in the sub-scanning direction of the resistance heater at the portion between each discrete electrode and the common electrode on each side of the discrete electrode is smaller than 100% of the center distance between the common electrodes on the opposite sides of the discrete electrode in the twin-dot independent perforation, the length of the heater elements in the sub-scanning direction becomes smaller than 100% of the sub-scanning pitch in the case where perforations are to be formed in the sub-scanning direction in substantially the same pitch as in the main scanning direction. When the length of the heater elements in the sub-scanning direction is smaller than 100% of the sub-scanning pitch in the single-dot independent perforation and the twin-dot independent perforation, heat generating areas become too small in the sub-scanning direction to form perforations in a proper size (30 to 40% in terms of the proportion of open area), which results in, for instance, a poor printing density. Accordingly, the length in the sub-scanning direction of the resistance heater at the portion between each pair of adjacent electrodes should be not smaller than 100% (preferably not smaller than 120%) of the center distance between the adjacent electrodes in the single-dot independent perforation and the length in the sub-scanning direction of the resistance heater at the portion between each discrete electrode and the common electrode on each side of the discrete electrode should be not smaller than 100% (preferably not smaller than 120%) of the center distance between the common electrodes on the opposite sides of the discrete electrode in the twin-dot independent perforation.

By limiting the volume of the heater element as described above, the following effect can be obtained. When formula (1) is satisfied in the single-dot independent perforation and when formula (2) is satisfied in the twin-dot independent perforation, the heater element can be optimal in volume to any resolution, the heater element can be high in temperature response and temperature contrast to any resolution, a high accuracy in the shape of the heater element can be ensured and a heat generating area necessary to perforation can be ensured in the case where perforations are to be formed in the sub-scanning direction in substantially the same pitch as in the main scanning direction. Specifically when $V/d^2$ or $V/D^2$ is not larger than 10 $\mu$m (preferably not larger than 5 $\mu$m), the heater element can be high in temperature response and temperature contrast to any resolution, and when $V/d^2$ or $V/D^2$ is not smaller than 0.2 $\mu$m (preferably not larger than 0.5 $\mu$m), a high accuracy in the shape of the heater element can be ensured and a heat generating area necessary to perforation can be ensured.

Thus, in accordance with the present invention, a high quality stencil can be thermally made by the use of a thick film thermal head which can be produced at a lower cost than the thin film thermal head, whereby the thermal stencil making apparatus can be manufactured at low cost.

DESCRIPTION OF THE PREFERRED EMBODIMENT

Figure 1:
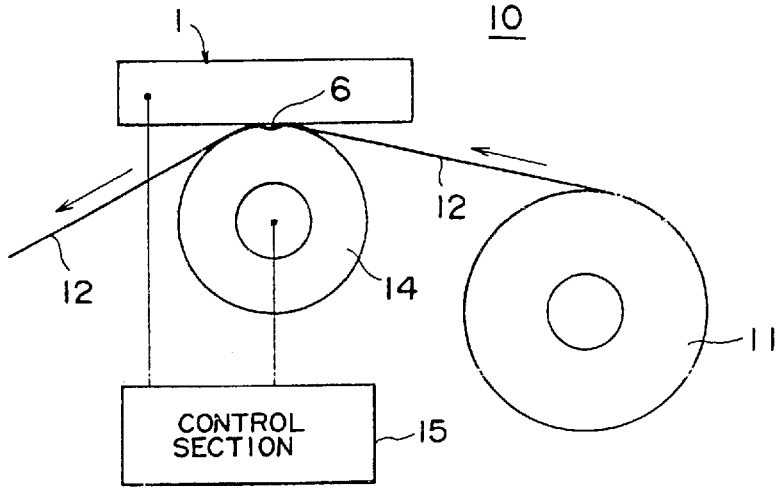
FIG. 1 is a schematic view of a thermal stencil making apparatus provided with a thermal head in accordance with an embodiment of the present invention.

In FIG. 1, a thermal stencil making apparatus 10 comprises a thick film thermal head 1 in accordance with an embodiment of the present invention, and a stencil material 12 unrolled from a roll 11 is inserted between the thermal head 1 and a platen roller 14 and is conveyed in response to rotation of the platen roller 14.

Figure 2:
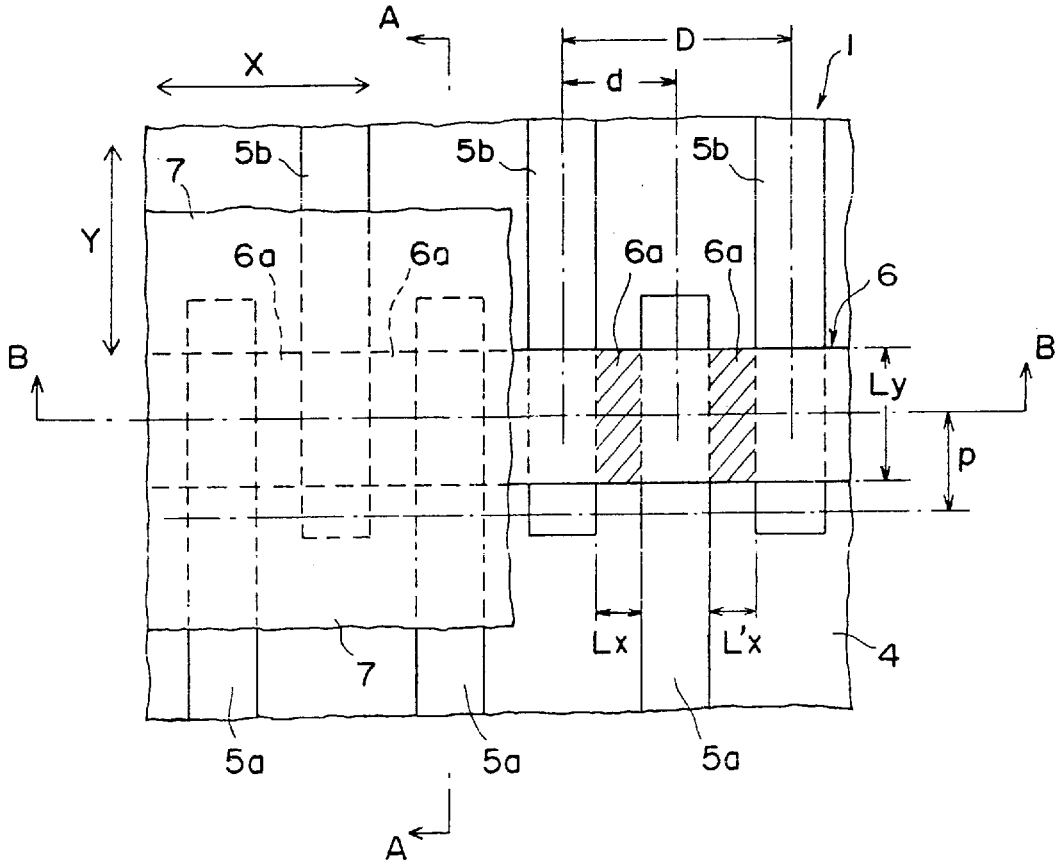
FIG. 2 is a fragmentary plan view of the thermal head employed in the thermal stencil making apparatus.
Figure 3:
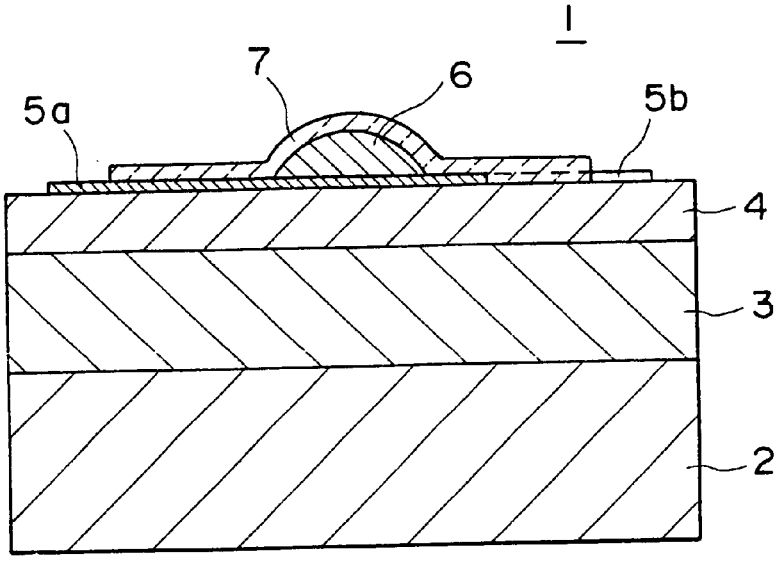
FIG. 3 is a cross-sectional view taken along line A—A in FIG. 2.
Figure 4:
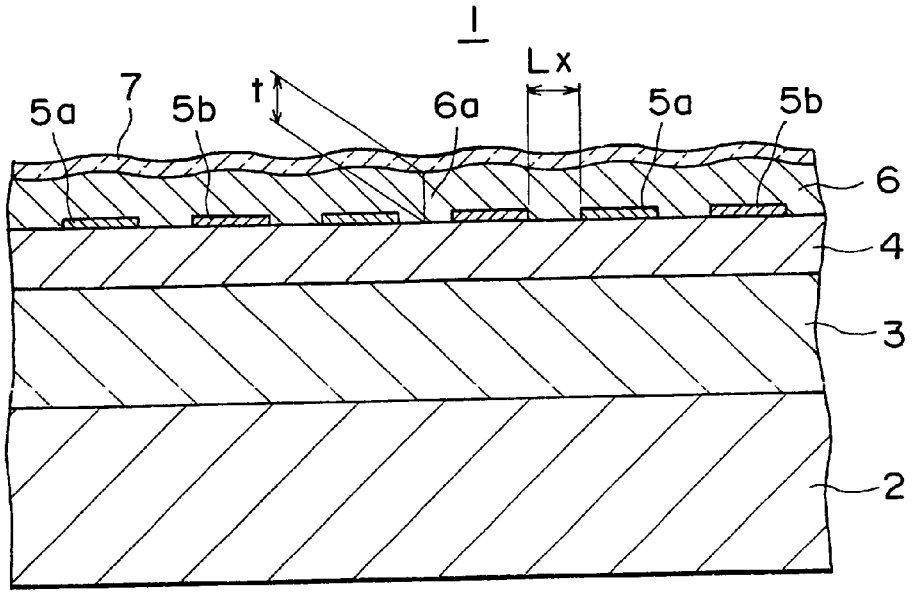
FIG. 4 is a cross-sectional view taken along line B—B in FIG. 2.

As shown in FIGS. 2 to 4, the thermal head 1 comprises a strip-like resistance heater 6 continuously extending in a main scanning direction X (a direction of width of the stencil material 12) and a plurality of discrete electrodes 5*a* and common electrodes 5*b* which extend in a sub-scanning direction Y in contact with the resistance heater 6 and are alternately arranged in the main scanning direction X. The parts 6*a* of the resistance heater 6 between the discrete electrodes 5*a* and the common electrodes 5*b* generate heat when energized through the discrete electrodes 5*a* and the common electrodes 5*b* as will be described in more detail later. That is, each of the parts 6*a* of the resistance heater 6 between the discrete electrodes 5*a* and the common electrodes 5*b* form a heater element, and the thermal head 1 is provided with an array of heater elements 6*a* extending in the main scanning direction X.

The stencil material 12 is conveyed in the sub-scanning direction Y with its thermoplastic film kept in contact with the thermal head 1 while the heater elements 6*a* of the thermal head 1 selectively energized through the discrete electrodes 5*a* and the common electrodes 5*b* according to an image signal representing the image of an original, whereby the thermoplastic film of the stencil material is imagewise perforated. The stencil material 12 may be either one comprising thermoplastic resin film and a porous base sheet or one comprising thermoplastic resin film with no base sheet.

A control section 15 controls power supply to the heater elements 6*a* and controls the platen roller 14 by way of a platen roller drive motor (not shown). That is, the control section 15 controls the electric voltages applied to the respective heater elements 6*a* and/or applying times for which the electric voltages are applied to the respective heater elements 6*a*, and the sub-scanning pitch at which the stencil material 12 is conveyed in the sub-scanning direction.

The thermal head 1 is formed by thick film process. That is, as shown in FIGS. 2 to 4, an electrical insulating substrate 3 and a glaze layer 4 is superposed on a heat radiating plate 2 of metal, and a plurality of discrete electrodes 5*a* and common electrodes 5*b* (in the form of thin plates) are formed on the glaze layer 4 alternately in the main scanning direction X to extend in the sub-scanning direction Y. The discrete electrodes 5*a* and the common electrodes 5*b* extend in opposite directions from a central portion of the glaze layer 4 with their central portions overlapping with each other in the main scanning direction. A strip-like resistance heater 6 is formed on the glaze layer 4 to extend in the main scanning direction across the central portions of the discrete electrodes 5*a* and the common electrodes 5*b*. A protective layer 7 of, for instance, glass is formed so as to cover the exposed part of the discrete electrodes 5*a* and the common electrodes 5*b* and the upper surface of the resistance heater 6. The thermal head 1 is brought into contact with the stencil material 12 at the surface of the protective layer 7.

The discrete electrodes 5*a* and the common electrodes 5*b* are respectively connected to the corresponding lines through wire bonding or the like, and electric voltages are applied across selected pairs of discrete electrode 5*a* and common electrode 5*b* adjacent to each other by a driver IC or the like, whereby the heater elements 6*a* between the selected pairs of discrete electrode 5*a* and common electrode 5*b* are energized and generate heat.

The discrete electrodes 5*a* and the common electrodes 5*b* need not extend accurately in the sub-scanning direction Y but may extend in any direction which intersects the main scanning direction. Further, the discrete electrodes 5*a* and the common electrodes 5*b* need not extend across the resistance heater 6 but may extend midway between opposite edges of the resistance heater 6. Further, the discrete electrodes 5*a* and the common electrodes 5*b* may be provided either above or under the resistance heater 6 so long as they are in contact with the resistance heater. For example, the discrete electrodes 5*a* may be provided above the resistance heater 6 with the common electrodes 5*b* provided below the same, and vice versa. Anyway, the path along which an electric current flows when different potentials are applied to the discrete electrode 5*a* and the common electrode 5*b* functions as a heater element 6*a* and generates heat.

When the thermal head 1 is to be driven in the twin-dot recording and in the single-dot independent perforation, the common electrodes 5*b* are connected in one line, and the discrete electrodes 5*a* are selectively applied with a pulse by a switching device according to on and off of corresponding pixels of an image signal representing an original. When one discrete electrode 5*a* is applied with a pulse, two heater elements 6*a* on opposite sides of the discrete electrode 5*a* generate heat, and two perforations are formed in the film of the stencil material 12 at two portions opposed to the heater elements 6*a* through the protective layer 7. In this case, two perforations correspond to one pixel. The center distance d (FIG. 2) between the discrete electrode 5*a* and the common electrode 5*b* adjacent to the discrete electrode 5*a* corresponds to the main scanning pitch, and the distance d is set constant for all the heater elements 6*a*. The sub-scanning pitch p (FIG. 2) is set to a constant value equal to the center distance d. The reason why the sub-scanning pitch and the main scanning pitch are made equal to each other is that it is the most efficient to equalize the sampling frequencies in the main scanning direction and the sub-scanning direction to each other from the viewpoint of the amount of information in an image (quality of an image) so long as the image is a typical image without any special anisotropy. The thickness t of the resistance heater 6 (or each heater element 6*a*) is in a range of 1 $\mu$m to 10 $\mu$m (preferably 2 $\mu$m to 6 $\mu$m). The widths of the electrodes 5*a* and 5*b* and the spaces therebetween are set so that the space Lx between adjacent electrodes 5*a* and 5*b* (the length of the heater element 6*a* in the main scanning direction X) is 20% to 60% (preferably 25% to 50%) of the center distance d between the electrodes 5*a* and 5*b* (the pitch of the heater elements in the main scanning direction X). Further the length Ly of the heater element 6*a* in the sub-scanning direction Y (the length in the sub-scanning direction Y of the resistance heater 6 at the portion between the adjacent electrodes 5*a* and 5*b*) is set to be 100% to 250% (preferably 120% to 200%) of the center distance d between the adjacent electrodes 5*a* and 5*b*. Further, the volume V ($\mu$m3) of the heater element 6*a* (the volume of the portion of the resistance heater 6 between the adjacent electrodes 5*a* and 5*b*) is set so that the value ($V/d^2$) obtained by dividing the volume V by the square of the center distance d ($\mu$m) is in the range of 0.2 to 10 (preferably 0.5 to 5).

When the thermal head 1 is to be driven in the single-dot recording and in the single-dot independent perforation, the common electrodes 5*b* are divided into first and second groups of common electrodes and are connected in two lines by the group. The first and second groups of common electrodes 5*b* are alternately disposed with a discrete electrode 5*a* therebetween. The first and second groups of common electrodes 5*b* are applied with a pulse at different timings by the group, while the discrete electrodes 5*a* are selectively applied with a pulse by a switching device according to on and off of corresponding pixels of an image signal representing an original in time to the time sharing drive of the first and second groups of the common electrodes 5*b*. When one discrete electrode 5*a* is applied with a pulse, a heater element 6*a* on one side of the discrete electrode 5*a* generates heat, and one perforation is formed in the film of the stencil material 12 at a portion opposed to the heater element 6*a* through the protective layer 7. In this case, one perforation corresponds to one pixel. The center distance d between the discrete electrode 5*a* and the common electrode 5*b* adjacent to the discrete electrode 5*a* corresponds to the main scanning pitch, and the distance d is set constant for all the heater elements 6*a*. The sub-scanning pitch p (FIG. 2) is set to a constant value equal to the center distance d. The reason why the sub-scanning pitch and the main scanning pitch are made equal to each other is that it is the most efficient to equalize the sampling frequencies in the main scanning direction and the sub-scanning direction to each other from the viewpoint of the amount of information in an image (quality of an image) so long as the image is a typical image without any special anisotropy. The thickness t of the resistance heater 6 (or each heater element 6*a*) is in a range of 1 $\mu$m to 10 $\mu$m (preferably 2 $\mu$m to 6 $\mu$m). The widths of the electrodes 5*a* and 5*b* and the spaces therebetween are set so that the space Lx between adjacent electrodes 5*a* and 5*b* (the length of the heater element 6*a* in the main scanning direction X) is 20% to 60% (preferably 25% to 50%) of the center distance d between the electrodes 5*a* and 5*b* (the pitch of the heater elements in the main scanning direction X). Further the length Ly of the heater element 6*a* in the sub-scanning direction Y (the length in the sub-scanning direction Y of the resistance heater 6 at the portion between the adjacent electrodes 5*a* and 5*b*) is set to be 100% to 250% (preferably 120% to 200%) of the center distance d between the adjacent electrodes 5*a* and 5*b*. Further, the volume V ($\mu$m3) of the heater element 6*a* (the volume of the portion of the resistance heater 6 between the adjacent electrodes 5*a* and 5*b*) is set so that the value ($V/d^2$) obtained by dividing the volume V by the square of the center distance d ($\mu$m) is in the range of 0.2 to 10 (preferably 0.5 to 5).

When the thermal head 1 is to be driven in the twin-dot recording and in the twin-dot independent perforation, the common electrodes 5*b* are connected in one line, and the discrete electrodes 5*a* are selectively applied with a pulse by a switching device according to on and off of corresponding pixels of an image signal representing an original. When one discrete electrode 5*a* is applied with a pulse, two heater elements 6*a* on opposite sides of the discrete electrode 5*a* generate heat, and two perforations are formed in the film of the stencil material 12 at two portions opposed to the heater elements 6*a* through the protective layer 7. In this case, two perforations correspond to one pixel. Twice the center distance d between the discrete electrode 5*a* and the common electrode 5*b* adjacent to the discrete electrode 5*a* corresponds to the main scanning pitch, and the distance d is set constant for all the heater elements 6*a*. The sub-scanning pitch p (FIG. 2) is set to a constant value equal to the center distance d. The reason why the sub-scanning pitch and the main scanning pitch are made equal to each other is that it is the most efficient to equalize the sampling frequencies in the main scanning direction and the sub-scanning direction to each other from the viewpoint of the amount of information in an image (quality of an image) so long as the image is a typical image without any special anisotropy. The thickness t of the resistance heater 6 (or each heater element 6*a*) is in a range of 1 μm to 10 μm (preferably 2 μm to 6 μm). The widths of the electrodes 5*a* and 5*b* and the spaces therebetween are set so that the sum of the space between the discrete electrode 5*a* and the common electrode 5*b* on one side of the discrete electrode 5*a* in the main scanning direction X (Lx) and the space between the discrete electrode 5*a* and the common electrode 5*b* on the other side of the discrete electrode 5*a* in the main scanning direction X (L'x), i.e., the sum of the lengths in the main scanning direction X of the heater elements 6*a* on the opposite sides of the discrete electrode 5*a*, is 20% to 60% (preferably 25% to 50%) of the center distance D between the common electrodes 5*b* on the opposite sides of the discrete electrode 5*a* (the main scanning pitch). Further the length Ly of the heater element 6*a* in the sub-scanning direction Y (the length in the sub-scanning direction Y of the resistance heater 6 at the portion between the adjacent electrodes 5*a* and 5*b*) is set to be 100% to 250% (preferably 120% to 200%) of the center distance D. Further, the sum V (μm3) of the volume of a part of the resistance heater 6 between the discrete electrode 5*a* and the common electrode 5*b* on one side of the discrete electrode 5*a* in the main scanning direction X and the volume of a part of the resistance heater 6 between the discrete electrode 5*a* and the common electrode 5*b* on the other side of the discrete electrode 5*a* in the main scanning direction X, i.e., the sum of the volumes of the heater elements 6*a* on the opposite sides of the discrete electrode 5*a*, is set so that the value ($V/D^2$) obtained by dividing the sum of the volumes V by the square of the center distance D (μm) between the common electrodes 5*b* on the opposite sides of the discrete electrode 5*a* is in the range of 0.2 to 10 (preferably 0.5 to 5).

The effect obtained by limiting the aforesaid factors in the thermal head 1 will be described with reference to FIGS. 5, 6, 7(7A and 7B) and 8, hereinbelow.

Figure 5:
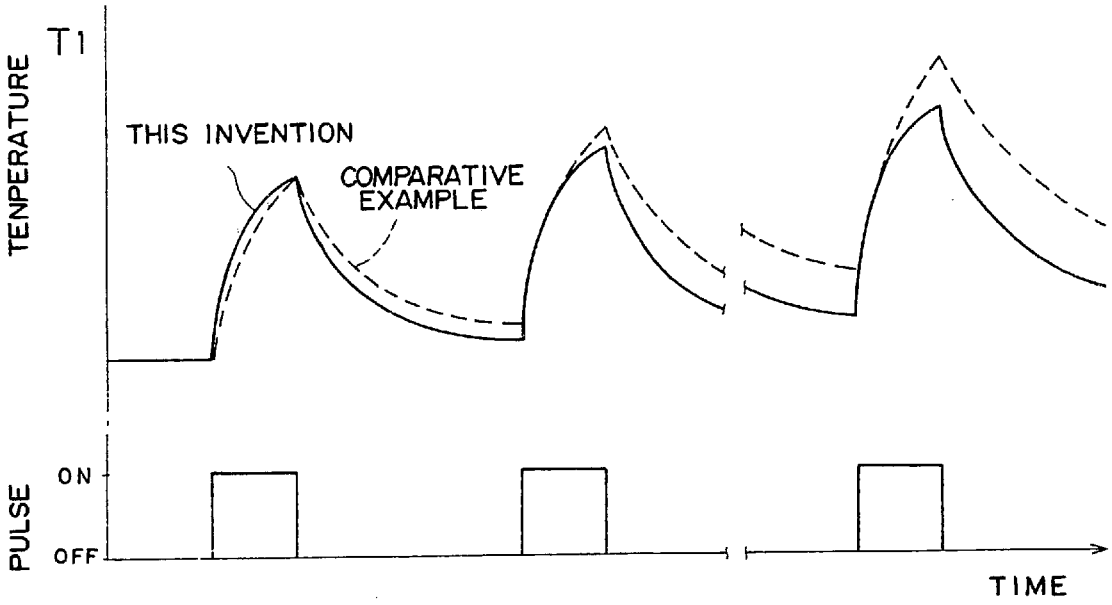
FIG. 5 is a graph showing the change in the temperature of the surface of the protective layer in response to on and off of the applied pulses for a thermal head which is not larger than 10 $\mu$m in thickness and a thermal head which is larger than 10 $\mu$m in thickness.

In FIG. 5, the solid line shows the change, in response to on and off of the applied pulses, in the temperature T1 of the surface of the protective layer 7 at the center of the heater element 6*a* which is not larger than 10 μm in thickness t (this invention) and the dashed line shows that of the heater element which is larger than 10 μm in thickness t (comparative example).

As can be seen from FIG. 5, when the thickness t of the heater element 6*a* is not larger than 10 μm, the temperature T1 of the surface of the protective layer 7 at the center of the heater element 6*a* quickly changes in response to on and off of the applied pulses.

Further, as can be seen from FIG. 5, when application of a pulse is repeated, the temperature T1 is gradually increased due to accumulation of heat. However, in the case of the thermal head 1 which is not larger than 10 μm in thickness, the degree of the temperature increase is less as compared with the thermal head 1 which is larger than 10 μm in thickness.

When the thickness t of the resistance heater 6 (or the heater element 6*a*) is limited to not larger than 10 μm, the heat capacity of each heater element 6*a* is reduced and response of the temperature of the heater element 6*a* to on and off of the applied pulses is increased, whereby the temperature contrast on the heater element 6*a* in the sub-scanning direction Y is increased and fluctuation of the shapes of the perforations in the sub-scanning direction Y can be suppressed. At the same time, energy required to heat the heater element 6*a* to a temperature necessary to perforate the film of the stencil material is reduced and the power consumption can be suppressed. Further, when accumulation of heat is large, perforations gradually become large in the sub-scanning direction Y, which can result in fluctuation in printing density and offset. Accordingly, by limiting the thickness t of the resistance heater 6 to not larger than 10 μm (preferably not larger than 6 μm), fluctuation in printing density can be suppressed and offset can be prevented.

Though the smaller the thickness t of the resistance heater 6 is, the smaller the heat capacity of the heater element 6*a* is, when the thickness t of the resistance heater 6 is smaller than 1 μm, the shape of the resistance heater 6 comes to largely depend upon the position in the main scanning direction due to limitation in precision of thick film printing process. In other words, uniformity of the shape of the resistance heater 6 in the main scanning direction largely deteriorates, which results in fluctuation in shape, resistance and heat generating properties of the heater elements 6*a* and results in fluctuation of the shape of the perforations obtained. Accordingly, the thickness of the resistance heater 6 should not be smaller than 1 μm, and preferably should not be smaller than 2 μm.

Figure 6:
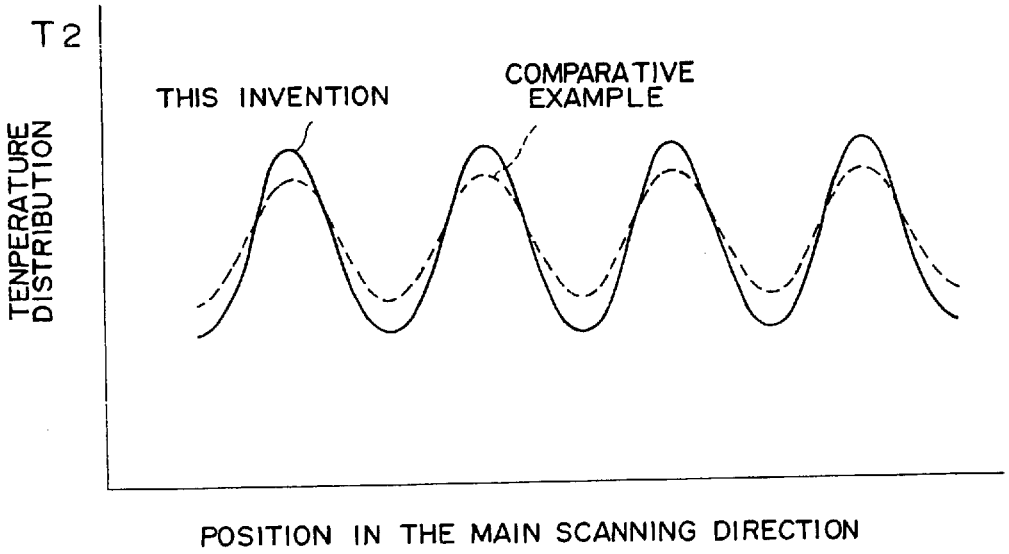
FIG. 6 is a graph showing the temperature contrast in the main scanning direction on a thermal head of the present invention at the time the temperature of the heater elements is maximized in comparison with that on a thermal head of a comparative example.
Figure 7A:
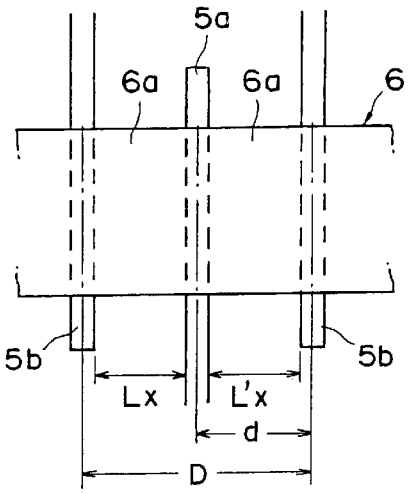
FIG. 7A is a view showing the thermal head of the comparative example where the space between each pair of adjacent electrodes in the main scanning direction is larger than 60% of the center distance between the adjacent electrodes.
Figure 7B:
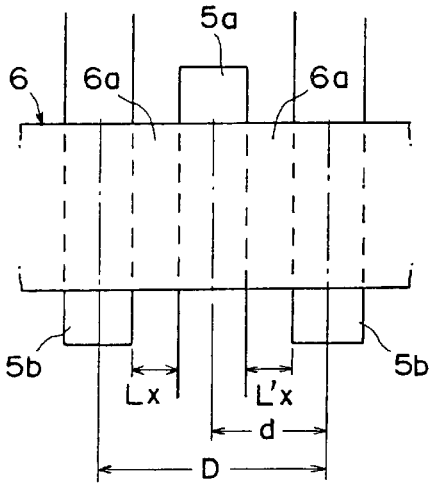
FIG. 7B is a view showing the thermal head of the present invention where the space between each pair of adjacent electrodes in the main scanning direction is not larger than 60% of the center distance between the adjacent electrodes.

FIG. 6 shows the temperature contrast T2 in the main scanning direction X on a thermal head of the present invention (solid line) at the time the temperature of the heater elements 6*a* is maximized in single-dot independent perforation in comparison with that on a thermal head of a comparative example (dashed line). As shown in FIG. 7A, in the thermal head of the comparative example, the space Lx between the adjacent electrodes 5*a* and 5*b* in the main scanning direction X is larger than 60% of the center distance d (constant irrespective of the position) between the adjacent electrodes 5*a* and 5*b*, whereas in the thermal head of the present invention, the space Lx between the adjacent electrodes 5*a* and 5*b* in the main scanning direction X is not larger than 60% of the center distance d between the adjacent electrodes 5*a* and 5*b*. As can be seen from FIG. 6, in the thermal head of the present invention, the temperature contrast is enhanced as compared with in the thermal head of the comparative example.

That is, when the length in the main scanning direction of the heater element 6*a* (Lx) is not larger than 60% of the main scanning pitch (d), the temperature contrast of the heater element 6*a* in the main scanning direction X is enhanced, whereby fluctuation in the shape of the perforations can be suppressed in the main scanning direction X and the perforations can be prevented from connecting to each other in the main scanning direction X. At the same time, energy required to heat the heater element 6*a* to a temperature necessary to perforate the film of the stencil material is reduced and the power consumption can be suppressed. Further, since the total amount of heat to be generated by the heater element 6*a* is reduced, accumulation of heat is suppressed when a plurality of stencils are continuously made, whereby the phenomenon that perforations gradually become large in the sub-scanning direction Y, which can result in fluctuation in printing density and offset, can be prevented. Accordingly, the space Lx should be not larger than 60% (preferably not larger than 50%) of the center distance d.

On the other hand, though the smaller the space Lx is, the more the temperature contrast of the thermal head is enhanced, when the space Lx is smaller than 20% of the center distance d, heat generating areas become too small in the main scanning direction X to form perforations in a proper size (30 to 40% in terms of the proportion of open area) in the main scanning direction X, which results in, for instance, a poor printing density. Accordingly, the space Lx should be not smaller than 20% (preferably not smaller than 25%) of the center distance d.

FIG. 6 also shows the temperature contrast T2 in the main scanning direction X on a thermal head of the present invention (solid line) at the time the temperature of the heater elements 6*a* is maximized in twin-dot independent perforation in comparison with that on a thermal head of a comparative example (dashed line). As shown in FIG. 7A, in the thermal head of the comparative example, the sum (Lx+L'x) of the space between the discrete electrode 5*a* and the common electrode 5*b* on one side of the discrete electrode 5*a* in the main scanning direction X (Lx) and the space between the discrete electrode 5*a* and the common electrode 5*b* on the other side of the discrete electrode 5*a* in the main scanning direction X (L'x), i.e., the sum of the lengths in the main scanning direction X of the heater elements 6*a* on the opposite sides of the discrete electrode 5*a* is larger than 60% of the center distance D between the common electrodes 5*b* on the opposite sides of the discrete electrode 5*a* (constant irrespective of the position), whereas in the thermal head of the present invention, the sum (Lx+L'x) of the spaces is not larger than 60% of the center distance D between the common electrodes 5*b* on the opposite sides of the discrete electrode 5*a*. As can be seen from FIG. 6, in the thermal head of the present invention, the temperature contrast is enhanced as compared with in the thermal head of the comparative example.

That is, when the sum of the lengths in the main scanning direction X of the heater elements 6*a* on the opposite sides of the discrete electrode 5*a* (Lx+L'x) is not larger than 60% of the main scanning pitch (D), the temperature contrast of the heater element 6*a* in the main scanning direction X is enhanced, whereby fluctuation in the shape of the perforations can be suppressed in the main scanning direction X and the perforations can be prevented from connecting to each other in the main scanning direction X. At the same time, energy required to heat the heater element 6*a* to a temperature necessary to perforate the film of the stencil material is reduced and the power consumption can be suppressed. Further, since the total amount of heat to be generated by the heater element 6*a* is reduced, accumulation of heat is suppressed when a plurality of stencils are continuously made, whereby the phenomenon that perforations gradually become large in the sub-scanning direction Y, which can result in fluctuation in printing density and offset, can be prevented. Accordingly, the sum (Lx+L'x) of the spaces should be not larger than 60% (preferably not larger than 50%) of the center distance On the other hand, though the smaller the sum (Lx+L'x) of the spaces is, the more the temperature contrast of the thermal head is enhanced, when the sum (Lx+L'x) of the spaces is smaller than 20% of the center distance D, heat generating areas become too small in the main scanning direction X to form perforations in a proper size (30 to 40% in terms of the proportion of open area) in the main scanning direction X, which results in, for instance, a poor printing density. Accordingly, the sum (Lx+L'x) of the spaces should be not smaller than 20% (preferably not smaller than 25%) of the center distance D.

Figure 8:
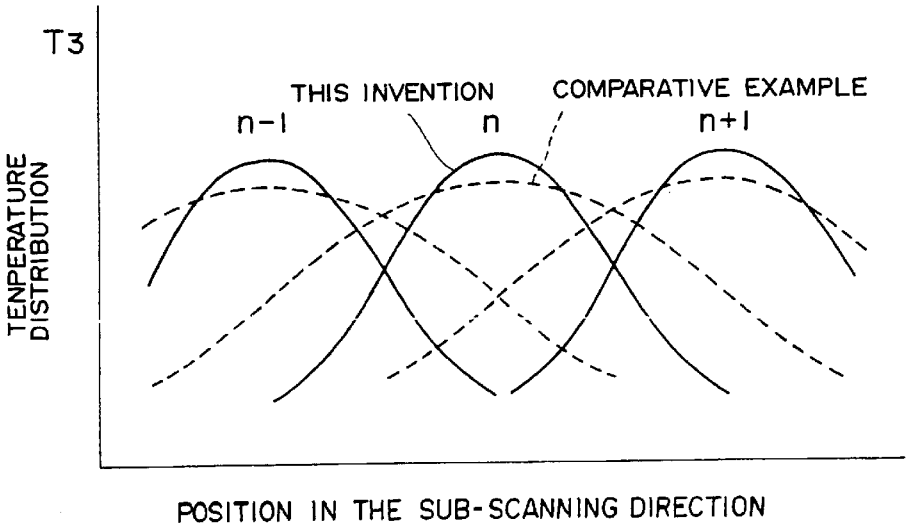
FIG. 8 is a view showing the temperature contrast on a thermal head of the present invention in the sub-scanning direction passing through the center of the heater element at the time the temperature of the heater element is maximized in comparison with that on a thermal head of a comparative example.

FIG. 8 shows the temperature contrast T3 on a thermal head of the present invention (solid line) in the sub-scanning direction Y passing through the center of the heater element 6*a* at the time the temperature of the heater element 6*a* is maximized in comparison with that on a thermal head of a comparative example (dashed line) in the case where the sub-scanning pitch and the main scanning pitch are equal to each other. In the thermal head of the comparative example, the length Ly in the sub-scanning direction Y is larger than 250% of the sub-scanning pitch p or the main scanning pitch (equal to the center distance d or D), whereas in the thermal head of the present invention, the length Ly in the sub-scanning direction Y is not larger than 250% of the sub-scanning pitch p or the main scanning pitch. As can be seen from FIG. 8, in the thermal head of the present invention, the temperature is more sharply lowered as the distance from the center of the heater element 6*a* increases. Further as can be seen from FIG. 8, the temperature at the part between the perforations in the sub-scanning direction is lower in the thermal head of the present invention than in the thermal head of the comparative example. In FIG. 8, the temperature contrast T3 for (n−1)-th perforation is indicated at (n−1), the temperature contrast T3 for n-th perforation is indicated at n, and the temperature contrast T3 for (n+1)-th perforation is indicated at (n+1).

That is, when the length Ly in the sub-scanning direction Y of the heater element 6*a* is not larger than 250% of the sub-scanning pitch p or the main scanning pitch, the temperature contrast of the heater element 6*a* in the sub-scanning direction Y is enhanced as compared with the thermal head of the comparative example where the length Ly in the sub-scanning direction Y of the heater element 6*a* is about 300% of the sub-scanning pitch p or the main scanning pitch, whereby fluctuation in the shape of the perforations can be suppressed in the sub-scanning direction Y and the perforations can be prevented from connecting to each other in the sub-scanning direction Y. At the same time, energy required to heat the heater element 6*a* to a temperature necessary to perforate the film of the stencil material is reduced and the power consumption can be suppressed. Further, since the total amount of heat to be generated by the heater element 6*a* is reduced, accumulation of heat is suppressed when a plurality of stencils are continuously made, whereby the phenomenon that perforations gradually become large in the sub-scanning direction Y, which can result in fluctuation in printing density and offset, can be prevented. Accordingly, the length Ly in the sub-scanning direction of the heater element 6*a* should be not larger than 250% of the sub-scanning pitch p or the main scanning pitch.

On the other hand, though the smaller the length Ly in the sub-scanning direction Y of the heater element 6*a* is, the more the temperature contrast of the heater element 6*a* in the sub-scanning direction is enhanced, when the length Ly in the sub-scanning direction Y of the heater element 6*a* is smaller than 100% of the sub-scanning pitch p or the main scanning pitch (equal to the center distance d or D), heat generating areas become too small in the sub-scanning direction Y to form perforations in a proper size (30 to 40% in terms of the proportion of open area) in the sub-scanning direction Y, which results in, for instance, a poor printing density. Accordingly, the length Ly in the sub-scanning direction Y of the heater element 6*a* should be not smaller than 100% (preferably not smaller than 120%) of the sub-scanning pitch p or the main scanning pitch (equal to the center distance d or D) and not larger than 250% (preferably not larger than 200%) of the same.

When formula (1) is satisfied in the single-dot independent perforation and when formula (2) is satisfied in the twin-dot independent perforation, the heater element 6*a* can be optimal in size to any resolution in the case where the sub-scanning pitch and the main scanning pitch are equal to each other, the heater element 6*a* can be high in temperature response and temperature contrast to any resolution, a high accuracy in the shape of the heater element 6*a* can be ensured and a heat generating area necessary to perforation can be ensured. $V/d^2$ or $V/D^2$ is set for the purpose of making the horizontal projected area of the heater element 6*a* proportional to a theoretical area $d^2$ or $D^2$ of a pixel and making constant the thickness of the heater element 6a irrespective of the value of $d^2$ or $D^2$. The former (to make the horizontal projected area of the heater element 6*a* proportional to a theoretical area of a pixel) is based on the fact that the two-dimensional shape of the perforations is similar irrespective of resolution. The latter (to make constant the thickness of the heater element 6*a*) is based on the fact that heat propagates from the heater element 6*a* to the film of the stencil material in a vertical direction (normal to the plane including both the main scanning direction X and the sub-scanning direction Y) without depending upon the horizontal shape in the plane including both the main scanning direction X and the sub-scanning direction Y provided that propagation of heat in the horizontal direction from the edge of the heater element 6*a* is ignored, and the fact that the thickness of the film is substantially constant irrespective of resolution in many of the thermal stencil making apparatuses which have been put into practice. Data obtained in the examples to be described later supports that formulae (1) and (2) are reasonable. That is, when $V/d^2$ or $V/D^2$is not larger than 10 (preferably not larger than 5), the heater element 6a can be high in temperature response and temperature contrast to any resolution, and when $V/d^2$ or $V/D^2$ is not smaller than 0.2 (preferably not larger than 0.5), a high accuracy in the shape of the heater element 6*a* can be ensured and a heat generating area necessary to perforation can be ensured.

Stencils were made by the use of the thermal heads in accordance with the present invention (embodiments 1 to 6) and by the use of thermal heads not in accordance with the present invention (comparative examples 1 to 10), and the stencils obtained and printings made by the use of the stencils were evaluated. The stencil making conditions and the result of the evaluation were as shown in the following tables 1 and 2. In the tables, "embodiment" is abbreviated as "em" (e.g., embodiment 1: em 1), and "comparative example" is abbreviated as "cp" (e.g., comparative example 1: cp 1). Further the main scanning direction is abbreviated as "m/d" and the sub-scanning direction is abbreviated as "s/d". In comparative examples 1 and 2 and embodiment 1, resolution was 300 dpi in both the main scanning direction and the sub-scanning direction, perforations were formed by single-dot recording/single-dot independent perforation, and the target proportion of open area were 40%. In comparative example 3 and embodiment 2, resolution was 300 dpi in the main scanning direction and 600 dpi in the sub-scanning direction, perforations were formed by twin-dot recording/single-dot independent perforation, and the target proportion of open area were 30%. In this case, though the resolution in the main scanning direction was 300 dpi, perforations were formed at the rate of 600/inch in both the main scanning direction and the sub-scanning direction. In comparative examples 4 and 5 and embodiment 3, resolution was 300 dpi in both the main scanning direction and the sub-scanning direction, perforations were formed by twin-dot recording/twin-dot independent perforation, and the target proportion of open area were 40%. In this case, two perforations were formed by two heater elements for one pixel and the two perforations formed were connected to each other in the main scanning direction. In comparative examples 6 and 7 and embodiment 4, resolution was 300 dpi in the main scanning direction and 400 dpi in the sub-scanning direction, perforations were formed by single-dot recording/single-dot independent perforation, and the target proportion of open area were 37%. In comparative examples 8 and 9 and embodiment 5, resolution was 400 dpi in both the main scanning direction and the sub-scanning direction, perforations were formed by single-dot recording/single-dot independent perforation, and the target proportion of open area were 35%. In comparative example 10 and embodiment 6, resolution was 600 dpi in both the main scanning direction and the sub-scanning direction, perforations were formed by single-dot recording/single-dot independent perforation, and the target proportion of open area were 30%. In each of the comparative examples and the embodiments, the center distance d or D between the electrodes and the sub-scanning pitch p were set according to the resolution described above, and the length Lx or Lx+L'x of the heater element in the main scanning direction (will be referred to as "the length Lx(+L'x)", hereinbelow), the length Ly of the heater element in the sub-scanning direction and the thickness t of the heater element were set in different values.

In the tables 1 and 2, the length Lx(+L'x) of the heater element in the main scanning direction, the length Ly of the heater element in the sub-scanning direction, the thickness t of the heater element and the recording system in the main scanning direction (single-dot recording or twin-dot recording, and single-dot independent perforation or twin-dot independent perforation: "1" denotes single-dot recording and single-dot independent perforation, "2" denotes twin-dot recording and twin-dot independent perforation) are shown. d or D denotes the center distance d between the adjacent electrodes in the case of the single-dot independent perforation and the center distance D between the common electrodes on the opposite sides of the discrete electrode in the case of the twin-dot independent perforation. Lx(+L'x) denotes the length Lx in the main scanning direction of one heater element in the case of the single-dot independent perforation and the sum Lx+L'x in the main scanning direction of two heater elements corresponding to one pixel in the case of the twin-dot independent perforation. Further, whether the conditions were satisfied is shown in the tables 1 and 2. That is, (−) denotes that the employed value was smaller than the lower limit, (+) denotes that the employed value was larger than the upper limit, and (○) denotes that the employed value was between the upper and lower limits, that is, satisfies the condition. Further evaluations of the stencils obtained and printings made by the use of the stencils are shown in the tables 1 and 2.

(1) Stencil Making Condition

The stencils were made by the use of pilot stencil making apparatuses which satisfied the respective conditions shown in the tables 1 and 2. As the heat-sensitive stencil material, RISOGRAPH GR MASTER 78W (RISO KAGAKU CORPORATION, JAPAN) was used. The ambient temperature was 23° C.

(2) Value of V/dp or V/Dp in Formula (1) or (2)

The value of V/dp or V/Dp employed is shown. In accordance with the present invention, the value should be not smaller than 0.2 and not larger than 10.

(3) Evaluations of the Diameters of the Perforation, the S/N Ratio of the Area of the Perforation and Influence of Heat Accumulation As the evaluation of the shape of the perforation, the diameters of the perforation in the main scanning direction and the sub-scanning direction, the S/N ratio of the area of the perforation and influence of heat accumulation were evaluated. The perforation is a separated opening corresponding to one pixel. The diameters of the perforation in the main scanning direction and the sub-scanning direction are defined as the lengths of the orthogonal projections onto lines parallel to the respective directions. The area of the perforation is defined as the area of a projection of a penetration in the thermoplastic film of the stencil material onto the film. The influence of heat accumulation was evaluated in terms of the ratio (%) of the area of the perforation formed with heat accumulation to that of the perforation formed without heat accumulation in one frame.

Specifically, A3 size stencils were made at intervals of about five minutes. Since there was a sufficient interval, the thermal head was considered to accumulate no heat at the start of making each stencil. In this state, A3 size stencils were made on the basis of an image including a solid image area continuous in the longitudinal direction of the A3 size stencil material (the sub-scanning direction) and images of an area which was made immediately after the start of the stencil making (an area at a distance of not smaller than 5 mm and not larger than 15 mm from the starting line: will be referred at as "non-heat-accumulation area", hereinbelow) and an area which was made a certain time after the start of the stencil making (an area at a distance of not smaller than 300 mm and not larger than 310 mm from the starting line: will be referred at as "heat-accumulation area", hereinbelow) were taken by a CCD camera through an optical microscope. Then by the use of an image analysis package MacSCOPE (MITANI Commercial Company), 100 penetrations in the film was taken out by binary-coding.

The average of the diameters of the perforations in the non-heat-accumulation area was taken as the diameter of the perforation. As the S/N ratio of the perforation, the S/N ratio of nominal-the-better of the area of each perforation in the non-heat-accumulation area was taken. Since the value of the S/N ratio of the perforation differs according to the measuring condition, it is difficult to unitary evaluate the S/N ratio of the perforation. However, it has been empirically known that the S/N ratio should be not smaller 10 db in order to obtain uniform transfer of ink through the perforation and preferably should be not smaller than 13 db. If the S/N ratio is smaller than 10 db, a serious problem arises.

The influence of heat accumulation was obtained by dividing the average of the areas of the perforations in the heat-accumulation area by that in the non-heat-accumulation area. In the case of comparative examples where the perforations were connected in the sub-scanning direction, the value obtained by the proportion of open area of an area of 10 pixel×10 pixel in the heat-accumulation area by that in the non-heat-accumulation area was shown in parentheses in the tables 1 and 2. The influence of heat accumulation is less as the value approaches 100 and is more as the value increases beyond 100.

(4) Printing Conditions

In any of the comparative examples and the embodiments, the stencil obtained was manually mounted on a printing drum of a stencil printer RISOGRAPH GR 377 (RISO KAGAKU CORPORATION, JAPAN), and print was made by the use of RISOGRAPH INK GR-HD under the standard conditions of the stencil printer (setting for power-on). Wood free paper was used and the ambient temperature was 23° C.

(5) Printing Density

Optical reflection density at the solid area of the printing was measured at 10 points on the printing by MACBETH reflection densitometer RD-918S and the average was calculated.

(6) Uniformity of Solid Area

Microscopic fluctuation in density with position (at cycles of 1 mm or less) in a solid area due to fluctuation in shape of the perforations was subjectively evaluated and classified as follows.

◎: No density fluctuation was observed.

○: Slight density fluctuation was observed but at such a level that problem would arise neither in solid reproduction of a letter original nor in tone reproduction of a photographic original.

Δ: Density fluctuation was observed at such a level that no problem would arise in solid reproduction of a letter original but tone reproduction of a photographic original would deteriorate.

×: Serious density fluctuation was observed at such a level that solid reproduction of a letter original and tone reproduction of a photographic original would both deteriorate.

(7) Blur of Thin Letters

The degree of blur (interruption in a pattern to be continuous) of thin letters in the printing due to fluctuation in shape of the perforations was subjectively evaluated and classified as follows.

◎: No blur was observed.

○: Slight blur was observed but at such a level that problem would arise neither in reproduction of thin letters (black letters on a white background) of a letter original nor in tone reproduction of highlights of a photographic original.

Δ: Blur was observed at such a level that no problem would arise in reproduction of thin letters (black letters on a white background) of a letter original but tone reproduction of highlights of a photographic original would deteriorate.

×: Serious blur was observed at such a level that reproduction of thin letters (black letters on a white background) of a letter original and tone reproduction of highlights of a photographic original would both deteriorate.

(8) Saturation of Thin Letters

The degree of saturation (loss of the white background between closely opposed two patterns) in the area of thin letters in the printing due to fluctuation in shape of the perforations was subjectively evaluated and classified as follows.

◎: No saturation was observed.

○: Slight saturation was observed but at such a level that problem would arise neither in reproduction of thin letters (black letters on a white background) of a letter original nor in tone reproduction of shadows of a photographic original.

Δ: Saturation was observed at such a level that no problem would arise in reproduction of thin letters (black letters on a white background) of a letter original but tone reproduction of shadows of a photographic original would deteriorate.

×: Serious saturation was observed at such a level that reproduction of thin letters (black letters on a white background) of a letter original and tone reproduction of shadows of a photographic original would both deteriorate.

(9) Offset

The degree of stain on the backside of a printing with ink on the surface of the immediately preceding printing in a stack of printings was subjectively evaluated and classified as follows.

◎: No offset was observed.

○: Slight offset was observed but at such a level that no problem would arise even if the amount of ink transfer was large and the printings were acceptable as formal printings.

Δ: Offset was observed at such a level that no problem would arise in an area of thin letters (black letters on a white background) or a highlight where the amount of ink transfer was relatively small but stain was conspicuous in a large solid area where the amount of ink transfer was relatively large. The printings were acceptable as informal printings though not acceptable as formal printings.

×: Serious offset was observed at such a level that stain was conspicuous in almost the whole area of the original and the printings were not acceptable even as informal printings.

TABLE 1

| | cp 1 | cp 2 | em 1 | cp 3 | em 2 | cp 4 | cp 5 | em 3 |
|---|---|---|---|---|---|---|---|---|
| m/d | | | | | | | | |
| resolution (dpi) | 300 | 300 | 300 | 300 | 300 | 300 | 300 | 300 |
| recording | 1 | 1 | 1 | 2 | 2 | 2 | 2 | 2 |
| independent | 1 | 1 | 1 | 1 | 1 | 2 | 2 | 2 |
| d or D (μm) | 84.7 | 84.7 | 84.7 | 42.3 | 42.3 | 84.7 | 84.7 | 84.7 |
| Lx(+ L'x) (μm) | 60 | 15 | 28 | 30 | 16 | 60 | 16 | 30 |
| s/d | | | | | | | | |
| resolution (dpi) | 300 | 300 | 300 | 600 | 600 | 300 | 300 | 300 |
| pitch p (μm) | 84.7 | 84.7 | 84.7 | 42.3 | 42.3 | 84.7 | 84.7 | 84.7 |
| length Ly (μm) | 250 | 75 | 130 | 150 | 70 | 250 | 75 | 130 |
| thickness of element (μm) | 15 | 1.5 | 5 | 10 | 3.5 | 15 | 1.5 | 5 |
| conditions | | | | | | | | |
| V/dp or V/Dp | 24.652 | 0.185 | 1.994 | 19.721 | 1.718 | 24.652 | 0.197 | 2.136 |
| 20% ≦ Lx(+ L'x) ≦ 60% | + | − | ○ | + | ○ | + | − | ○ |
| Ly/p | + | − | ○ | + | ○ | + | − | ○ |
| t | + | ○ | ○ | ○ | ○ | + | ○ | ○ |
| formula (1) or (2) | + | − | ○ | + | ○ | + | − | ○ |
| target value of proportion of open area (%) | 40 | 40 | 40 | 30 | 30 | 40 | 40 | 40 |
| master making conditions | | | | | | | | |
| energy applied (μj) | 192 | 70 | 93.75 | 74 | 41.25 | 206.4 | 77 | 103.125 |
| power applied (mW) | 400 | 200 | 250 | 185 | 125 | 430 | 220 | 275 |
| applying time (μs) | 480 | 350 | 375 | 400 | 330 | 480 | 350 | 375 |
| cycle (ms) | 5 | 5 | 5 | 3 | 3 | 5 | 5 | 5 |
| evaluation of perforations | | | | | | | | |
| diameter m/d (μm) | 42.3 | 37.5 | 60.8 | 23.9 | 25.8 | 44 | 40.2 | 62.3 |
| diameter s/d (μm) | >84.7 | 39.3 | 59.8 | >42.3 | 26.1 | >84.7 | 38.8 | 58.6 |
| open area (%) | 41 | 17 | 40 | 34 | 30 | 42 | 18 | 39 |
| perf. S/N ratio (db) | — | 9.4 | 13.5 | — | 12.7 | — | 9.1 | 13.2 |
| heat accu. (%) | (151) | 106 | 115 | (131) | 103 | (155) | 108 | 116 |
| evaluation of printings | | | | | | | | |
| density | 1.12 | 0.70 | 1.14 | 1.01 | 1.10 | 1.09 | 0.68 | 1.12 |
| solid uniformity | x | x | ◎ | x | ◎ | x | x | ◎ |
| thin letter blur | Δ | x | ◎ | x | ○ | Δ | x | ◎ |
| thin letter sat. | x | ◎ | ○ | x | ◎ | x | ◎ | ○ |
| offset | x | ◎ | ◎ | ○ | ◎ | x | ◎ | ◎ |

TABLE 2

| | cp 6 | cp 7 | em 4 | cp 8 | cp 9 | em 5 | cp 10 | em 6 |
|---|---|---|---|---|---|---|---|---|
| m/d | | | | | | | | |
| resolution (dpi) | 300 | 300 | 300 | 400 | 400 | 400 | 600 | 600 |
| recording | 1 | 1 | 1 | 1 | 1 | 1 | 1 | 1 |
| independent | 1 | 1 | 1 | 1 | 1 | 1 | 1 | 1 |
| d or D (μm) | 84.7 | 84.7 | 84.7 | 63.5 | 63.5 | 63.5 | 42.3 | 42.3 |
| Lx(+ L'x) (μm) | 60 | 15 | 28 | 41 | 11 | 22.5 | 30 | 16 |
| s/d | | | | | | | | |
| resolution (dpi) | 400 | 400 | 400 | 400 | 400 | 400 | 600 | 600 |
| pitch p (μm) | 63.5 | 63.5 | 63.5 | 63.5 | 63.5 | 63.5 | 42.3 | 42.3 |
| length Ly (μm) | 200 | 60 | 110 | 200 | 60 | 100 | 150 | 70 |
| thickness of element (μm) | 15 | 1.5 | 5 | 10 | 0.9 | 5 | 10 | 3.5 |

TABLE 2-continued

| | cp 6 | cp 7 | em 4 | cp 8 | cp 9 | em 5 | cp 10 | em 6 |
|---|---|---|---|---|---|---|---|---|
| conditions | | | | | | | | |
| V/dp or V/Dp | 26.295 | 0.197 | 2.250 | 15.972 | 0.116 | 2.191 | 19.721 | 1.718 |
| 20% ≦ Lx(+ L'x) ≦ 60% | + | − | ○ | + | − | ○ | + | ○ |
| Ly/p | + | − | ○ | + | − | ○ | + | ○ |
| t | + | ○ | ○ | ○ | − | ○ | ○ | ○ |
| formula (1) or (2) | + | − | ○ | + | − | ○ | + | ○ |
| target value of proportion of open area (%) | 37 | 37 | 37 | 35 | 35 | 35 | 30 | 30 |
| master making conditions | | | | | | | | |
| energy applied (μj) | 139.5 | 59.2 | 80.5 | 103.5 | 33.6 | 57.8 | 74 | 41.25 |
| power applied (mW) | 310 | 185 | 230 | 230 | 120 | 170 | 185 | 125 |
| applying time (μs) | 450 | 320 | 350 | 450 | 280 | 340 | 400 | 330 |
| cycle (ms) | 4 | 4 | 4 | 4 | 4 | 4 | 3 | 3 |
| evaluation of perforations | | | | | | | | |
| diameter m/d (μm) | 41.5 | 35.1 | 57 | 31.6 | 25.6 | 42.5 | 24.1 | 25.5 |
| diameter s/d (μm) | >63.5 | 29 | 46.6 | >63.5 | 30.3 | 41.8 | >42.3 | 26.2 |
| open area (%) | 37 | 16 | 37 | 36 | 15 | 35 | 33 | 30 |
| perf. S/N ratio (db) | — | 9.8 | 13.3 | — | 8.8 | 13.1 | — | 12.8 |
| heat accu. (%) | (146) | 105 | 112 | (139) | 104 | 107 | (133) | 102 |
| evaluation of printings | | | | | | | | |
| density | 109 | 0.67 | 1.12 | 1.03 | 0.66 | 10.8 | 0.99 | 1.09 |
| solid uniformity | x | x | ◎ | x | x | ◎ | x | ◎ |
| thin letter blur | Δ | x | ◎ | Δ | x | ◎ | x | ○ |
| thin letter sat. | x | ◎ | ◎ | x | ◎ | ◎ | x | ◎ |
| offset | x | ◎ | ◎ | Δ | ◎ | ◎ | ○ | ◎ |

As can be seen from the tables 1 and 2, in the case of the embodiment 1, parts where the pattern was slightly thicker than intended were observed in evaluation of saturation of thin letters, but at such a level that problem would arise neither in deciphering thin letters nor in tone reproduction. The embodiment 1 was excellent in all the other items. In the case of the embodiment 2, interruption in a pattern to be continuous was slightly observed in evaluation of blur of thin letters, but at such a level that problem would arise neither in deciphering thin letters nor in tone reproduction. The embodiment 2 was excellent in all the other items. In the case of the embodiment 3, parts where the pattern was slightly thicker than intended were observed in evaluation of saturation of thin letters, but at such a level that problem would arise neither in deciphering thin letters nor in tone reproduction. The embodiment 3 was excellent in all the other items. The embodiment 4 was excellent in all the items. The embodiment 5 was excellent in all the items. In the case of the embodiment 6, interruption in a pattern to be continuous was slightly observed in evaluation of blur of thin letters, but at such a level that problem would arise neither in deciphering thin letters nor in tone reproduction. The embodiment 6 was excellent in all the other items.

In the case of the comparative example 1, the perforations were connected in the sub-scanning direction. Accordingly, the diameters of the perforations in the main scanning direction were made smaller to realize the target proportion of open area, which resulted in perforations extending in the sub-scanning direction like stripes in the solid area. Further, though it was impossible to obtain the S/N ratio of the area of the perforation since the perforations were not separated from each other, molten resin grounds accumulated on parts of the film which were in a poor contact with the base film or the heater element due to poor temperature contrast and/or poor temperature response of the heater element, and local fluctuation in the proportion of open area was very large. Further since heat generation in one frame was large and influence of heat accumulation was very large. Accordingly, reproduction of thin letters and/or fine patterns largely depended upon the direction (the main scanning direction or the sub-scanning direction), which resulted in poor pattern reproduction. Further the large local fluctuation in the proportion of open area resulted in fluctuation in printing density from position to position in a solid area. Further, in an area where the proportion of printing area was large, ink transfer became excessive due to connected perforations, which resulted in significant offset. Further, due to large influence of heat accumulation, printing density in a solid area in the upper part of the printings largely differed from that in a solid area in the lower part of the printings.

In the case of the comparative example 2, the size of the heater elements was too small to obtain the target value of the proportion of open area, and increase in the electric power (e.g., applied energy) resulted only in promoted deterioration, for instance, in the resistance of the heater element with the shape of the perforations kept substantially at the values shown in table 1. Accordingly, the perforations were too small and the proportion of open area was far smaller than the target value, whereby the printing density was very poor.

Evaluation of the comparative example 3 was substantially equivalent to that of the comparative example 1. That is, the perforations were connected in the sub-scanning direction and accordingly, the diameters of the perforations in the main scanning direction were made smaller to realize the target proportion of open area, which resulted in perforations extending in the sub-scanning direction like stripes in the solid area. Further, though it was impossible to obtain the S/N ratio of the area of the perforation since the perforations were not separated from each other, local fluctuation in the proportion of open area was very large and influence of heat accumulation was very large. Accordingly, reproduction of thin letters and/or fine patterns was poor. Further the large local fluctuation in the proportion of open area resulted in fluctuation in printing density from position to position in a solid area. Further, due to large influence of heat accumulation, printing density in a solid area in the upper part of the printings differed from that in a solid area in the lower part of the printings.

Evaluation of the comparative example 4 was substantially equivalent to that of the comparative examples 1 and 3. That is, the perforations were connected in the sub-scanning direction and accordingly, the diameters of the perforations in the main scanning direction were made smaller to realize the target proportion of open area, which resulted in perforations extending in the sub-scanning direction like stripes in the solid area. Further, though it was impossible to obtain the S/N ratio of the area of the perforation since the perforations were not separated from each other, local fluctuation in the proportion of open area was very large and influence of heat accumulation was very large. Accordingly, reproduction of thin letters and/or fine patterns was poor. Further, in an area where the proportion of printing area was large, offset was severe. Further the printing density fluctuated from position to position in a solid area. Further, due to large influence of heat accumulation, printing density in a solid area in the upper part of the printings largely differed from that in a solid area in the lower part of the printings.

Evaluation of the comparative example 5 was substantially equivalent to that of the comparative example 2. That is, the size of the heater elements was too small to obtain the target value of the proportion of open area, and increase in the electric power (e.g., applied energy) resulted only in promoted deterioration of the heater element with the shape of the perforations kept substantially at the values shown in table 1. Accordingly, the perforations were too small and the proportion of open area was far smaller than the target value, whereby the printing density was very poor.

Evaluation of the comparative example 6 was substantially equivalent to that of the comparative examples 1, 3 and 4. That is, the perforations were connected in the sub-scanning direction and accordingly, the diameters of the perforations in the main scanning direction were made smaller to realize the target proportion of open area, which resulted in perforations extending in the sub-scanning direction like stripes in the solid area. Further, though it was impossible to obtain the S/N ratio of the area of the perforation since the perforations were not separated from each other, local fluctuation in the proportion of open area was very large and influence of heat accumulation was very large. Accordingly, reproduction of thin letters and/or fine patterns was poor. Further, in an area where the proportion of printing area was large, offset was severe. Further the printing density fluctuated from position to position in a solid area. Further, due to large influence of heat accumulation, printing density in a solid area in the upper part of the printings largely differed from that in a solid area in the lower part of the printings.

Evaluation of the comparative example 7 was substantially equivalent to that of the comparative examples 2 and 5. That is, the size of the heater elements was too small to obtain the target value of the proportion of open area, and increase in the electric power resulted only in promoted deterioration of the heater element with the shape of the perforations kept substantially at the values shown in table 2. Accordingly, the perforations were too small and the proportion of open area was far smaller than the target value, whereby the printing density was very poor.

Evaluation of the comparative example 8 was substantially equivalent to that of the comparative examples 1, 3, 4 and 6. That is, the perforations were connected in the sub-scanning direction and accordingly, the diameters of the perforations in the main scanning direction were made smaller to realize the target proportion of open area, which resulted in perforations extending in the sub-scanning direction like stripes in the solid area. Further, though it was impossible to obtain the S/N ratio of the area of the perforation since the perforations were not separated from each other, local fluctuation in the proportion of open area was very large and influence of heat accumulation was very large. Accordingly, reproduction of thin letters and/or fine patterns was poor. Further, in an area where the proportion of printing area was large, offset was severe. Further the printing density fluctuated from position to position in a solid area. Further, due to large influence of heat accumulation, printing density in a solid area in the upper part of the printings largely differed from that in a solid area in the lower part of the printings.

Evaluation of the comparative example 9 was substantially equivalent to that of the comparative examples 2, 5 and 7. That is, the size of the heater elements was too small to obtain the target value of the proportion of open area, and increase in the electric power resulted only in promoted deterioration of the heater element with the shape of the perforations kept substantially at the values shown in table 2. Accordingly, the perforations were too small and the proportion of open area was far smaller than the target value, whereby the printing density was very poor. Further the heater elements were small in thickness, 0.9 $\mu$m, fluctuation in shape of the heater elements were very large and the S/N ratio of shape of the perforations was very poor.

Evaluation of the comparative example 10 was substantially equivalent to that of the comparative examples 1, 3, 4, 6 and 8. That is, the perforations were connected in the sub-scanning direction and accordingly, the diameters of the perforations in the main scanning direction were made smaller to realize the target proportion of open area, which resulted in perforations extending in the sub-scanning direction like stripes in the solid area. Further, though it was impossible to obtain the SIN ratio of the area of the perforation since the perforations were not separated from each other, local fluctuation in the proportion of open area was very large and influence of heat accumulation was very large. Accordingly, reproduction of thin letters and/or fine patterns was poor. Further, in an area where the proportion of printing area was large, offset was severe. Further the printing density fluctuated from position to position in a solid area. Further, due to large influence of heat accumulation, printing density in a solid area in the upper part of the printings largely differed from that in a solid area in the lower part of the printings.

What is claimed is:

1. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, and the length in the sub-scanning direction of the resistance heater at the portion between each pair of adjacent electrodes is not smaller than 100% and not larger than 250% of the center distance between the adjacent electrodes.

2. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, and the length in the sub-scanning direction of the resistance heater at the portion between each pair of adjacent electrodes is not smaller than 100% and not larger than 250% of the center distance between the adjacent electrodes.

3. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the resistance heater is not smaller than 1 $\mu$m and not larger than 10 $\mu$m in thickness, the sum of the space between each discrete electrode and the common electrode on one side of the discrete electrode in the main scanning direction and the space between the discrete electrode and the common electrode on the other side of the discrete electrode in the main scanning direction is not smaller than 20% and not larger than 60% of the center distance between the common electrodes on the opposite sides of the discrete electrode, and the length in the sub-scanning direction of the resistance heater at the portion between each discrete electrode and the common electrode on each side of the discrete electrode is not smaller than 100% and not larger than 250% of the center distance between the common electrodes on the opposite sides of the discrete electrode.

4. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu$m) represents the center distance between the adjacent electrodes.

5. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein the improvement comprises that the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu$m) represents the center distance between the adjacent electrodes.

6. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the following formula (2) is satisfied, $$0.2 \leqq V/D^2 \leqq 10 \quad (2)$$

wherein V (in $\mu m^3$) represents the sum of the volume of part of the resistance heater between each discrete electrode and the common electrode on one side of the discrete electrode in the main scanning direction and the volume of a part of the resistance heater between the discrete electrode and the common electrode on the other side of the discrete electrode in the main scanning direction and D (in $\mu$m) represents the center distance between the common electrodes on the opposite sides of the discrete electrode.

7. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of electrodes of at least two lines which extend in a direction intersecting the main scanning direction in contact with the resistance heater and are alternately arranged in the main scanning direction, and a protective layer which covers exposed part of the resistance heater and the electrodes, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, the length in the sub-scanning direction of the resistance heater at the portion between each pair of adjacent electrodes is not smaller than 100% and not larger than 250% of the center distance between the adjacent electrodes, and the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu$m) represents the center distance between the adjacent electrodes.

8. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes comprising first and second groups of common electrodes which are connected to each other by group and are alternately arranged in the main scanning direction, wherein the improvement comprises that the resistance heater is not smaller than 1 $\mu$m and not larger than 10 $\mu$m in thickness, the space between each pair of adjacent electrodes in the main scanning direction is not smaller than 20% and not larger than 60% of the center distance between the adjacent electrodes, the length in the sub-scanning direction of the resistance heater at the portion between each pair of adjacent electrodes is not smaller than 100% and not larger than 250% of the center distance between the adjacent electrodes, and the following formula (1) is satisfied, $$0.2 \leqq V/d^2 \leqq 10 \quad (1)$$

wherein V (in $\mu m^3$) represents the volume of a part of the resistance heater between each pair of adjacent electrodes, and d (in $\mu$m) represents the center distance between the adjacent electrodes.

9. A thick film thermal head for making a stencil by thermally perforating a stencil material comprising an electrical insulating substrate and a glaze layer superposed on a heat radiating plate in this order, a resistance heater formed on the glaze layer to continuously extend in a main scanning direction, a plurality of discrete electrodes and common electrodes which extend in a direction intersecting the main scanning direction in contact with the resistance heater and are alternately arranged in the main scanning direction, and a protective layer which covers exposed part of the resistance heater and the electrodes, the common electrodes being connected to each other in one line, wherein the improvement comprises that the resistance heater is not smaller than 1 $\mu$m and not larger than 10 $\mu$m in thickness, the sum of the space between each discrete electrode and the common electrode on one side of the discrete electrode in the main scanning direction and the space between the discrete electrode and the common electrode on the other side of the discrete electrode in the main scanning direction is not smaller than 20% and not larger than 60% of the center distance between the common electrodes on the opposite sides of the discrete electrode, the length in the sub-scanning direction of the resistance heater at the portion between each discrete electrode and the common electrode on each side of the discrete electrode is not smaller than 100% and not larger than 250% of the center distance between the common electrodes on the opposite sides of the discrete electrode, and the following formula (2) is satisfied, $$0.2 \leqq V/D^2 \leqq 10 \quad (2)$$

wherein V (in $\mu m^3$) represents the sum of the volume of a part of the resistance heater between each discrete electrode and the common electrode on one side of the discrete electrode in the main scanning direction and the volume of a part of the resistance heater between the discrete electrode and the common electrode on the other side of the discrete electrode in the main scanning direction and D (in $\mu$m) represents the center distance between the common electrodes on the opposite sides of the discrete electrode.

* * * * *